US010036136B2

(12) United States Patent
Higuchi et al.

(10) Patent No.: US 10,036,136 B2
(45) Date of Patent: Jul. 31, 2018

(54) SMALL-SIZED HYDRAULIC EXCAVATOR

(71) Applicant: Hitachi Construction Machinery Tierra Co., Ltd., Koka-shi, Shiga (JP)

(72) Inventors: Takashi Higuchi, Koka (JP); Kouhei Maeda, Kusatsu (JP); Tomoyuki Tanaka, Yasu (JP); Junya Kawamoto, Moriyama (JP)

(73) Assignee: Hitachi Construction Machinery Tierra Co., Ltd., Koka-shi (JP)

( * ) Notice: Subject to any disclaimer, the term of this patent is extended or adjusted under 35 U.S.C. 154(b) by 0 days.

(21) Appl. No.: 15/447,383

(22) Filed: Mar. 2, 2017

(65) Prior Publication Data

US 2018/0058033 A1 Mar. 1, 2018

(30) Foreign Application Priority Data

Sep. 1, 2016 (JP) ..... 2016-170770

(51) Int. Cl.
*E02F 3/32* (2006.01)
*E02F 9/16* (2006.01)
(Continued)

(52) U.S. Cl.
CPC ..... *E02F 3/325* (2013.01); *E02F 3/384* (2013.01); *E02F 9/16* (2013.01); *E02F 9/163* (2013.01);
(Continued)

(58) Field of Classification Search
CPC ... E02F 3/325; E02F 3/384; E02F 9/16; E02F 9/163; E02F 9/18; E02F 9/2004; E02F 9/22; E02F 9/2267; G05G 1/30
See application file for complete search history.

(56) References Cited

U.S. PATENT DOCUMENTS 3,841,172 A * 10/1974 Pilch ..... G05G 1/30 74/512
6,052,644 A * 4/2000 Murakami ..... B60K 31/0058 123/319

(Continued)

FOREIGN PATENT DOCUMENTS

JP 1996-206222 * 3/1996
JP 2005-146847 A 6/2005
JP 2008-G30541 * 5/2008

*Primary Examiner* — Jamie L McGowan
(74) *Attorney, Agent, or Firm* — Crowell & Moring LLP

(57) ABSTRACT

A floor support frame (8) is provided with a left side pilot valve (21). The left side pilot valve (21) is provided with a left side operating pedal (23) that is foot-operated. The left side operating pedal (23) is configured of a first foot board (26) that is mounted on the left pilot valve (21) to be rotatable in an upper-lower direction, a shaft (27) that is mounted in a rear portion of the first foot board (26), and a second foot board (28) that is mounted through the shaft (27) on the first foot board (26) to be rotatable in a horizontal direction. The second foot board (28) is rotatable between a storage position of overlapping the first foot board (26) and a use position of being rotated in the rear side of the first foot board (26). An operation regulating mechanism (29) is provided in the front side of the first foot board (26) to be engaged to the second foot board (28) when the second foot board (28) is rotated to the storage position to regulate a foot operation.

5 Claims, 14 Drawing Sheets

(51) Int. Cl.

| | |
|---|---|
| ***E02F 9/18*** | (2006.01) |
| ***E02F 9/20*** | (2006.01) |
| ***E02F 9/22*** | (2006.01) |
| ***E02F 3/38*** | (2006.01) |
| ***G05G 1/30*** | (2008.04) |

(52) U.S. Cl.
CPC ..... *E02F 9/18* (2013.01); *E02F 9/2004* (2013.01); *E02F 9/22* (2013.01); *E02F 9/2267* (2013.01); *G05G 1/30* (2013.01)

(56) References Cited

U.S. PATENT DOCUMENTS

| | | | | |
|---|---|---|---|---|
| 2012/0279340 | A1* | 11/2012 | Davis | B66C 13/56<br>74/484 R |
| 2014/0070568 | A1* | 3/2014 | Tabeta | E02F 3/325<br>296/190.09 |
| 2014/0306488 | A1* | 10/2014 | Tanaka | E02F 3/325<br>296/190.08 |

* cited by examiner

SMALL-SIZED HYDRAULIC EXCAVATOR

TECHNICAL FIELD

The present invention relates to small-sized hydraulic excavators used suitably for an excavating operation in a narrow working site such as urban areas, and particularly, to a small-sized hydraulic excavator that is provided with an operating pedal to be foot-operated by an operator.

BACKGROUND ART

In general, a small-sized hydraulic excavator called a mini-excavator is used suitably for an excavating operation in a narrow working site such as urban areas. Since this small-sized hydraulic excavator is used for a demolition work in the inside of a building or an excavating operation in a narrow area of a street, a machine weight thereof is set to approximately 0.8 to 4 tons, for example. In such small-sized hydraulic excavator, a foot range in which an operator puts the foot on an upper revolving structure is designed to be small.

Here, the small-sized hydraulic excavator is configured of an automotive lower traveling structure, an upper revolving structure that is supported through a revolving device on the lower traveling structure, and a front device that is tiltably mounted in the front side of the upper revolving structure. The small-sized hydraulic excavator is configured in such a manner that the upper revolving structure does not interfere with obstacles in the circumference upon operating/revolving the upper revolving structure in the narrow working site. That is, the small-sized hydraulic excavator is configured in such a manner that at least the rear side of the upper revolving structure (outer peripheral surface of a counterweight) can revolve within a vehicle width of the lower traveling structure to a vehicle width dimension of the lower traveling structure (width dimension between left and right drive devices).

The upper revolving structure has a revolving frame that is formed as a support structure, and a counterweight is mounted in the rear side of the revolving frame for acting as a weight balance to the front device. In addition, an engine is mounted in the front side to the counterweight on the revolving frame in a horizontal state of extending in the left-right direction, and a hydraulic pump is driven by the engine.

In the small-sized hydraulic excavator, various types of equipment is arranged in a limited installation space on the small revolving frame. An operator's seat stand is provided on the revolving frame to cover an upper side of the engine, and an operator's seat is mounted on the operator's seat stand. Further, a floor member is provided in front of the operator's seat stand to extend in the left-right direction on the revolving frame. The floor member is a place on which an operator who has sat on the operator's seat puts the feet, and the left side of the floor member is an entrance way to the operator's seat.

A pilot valve and an operating pedal are provided in a front position of the floor member, wherein the pilot valve controls supply/discharge of a pilot pressure to a control valve device and the operating pedal is provided in the pilot valve and is foot-operated in the upper-lower direction by an operator.

Here, the floor member of the small-sized hydraulic excavator has a narrow space surrounded by the engine, an oil reservoir tank and the front device. Therefore, the operating pedal provided in the front position of the floor member is configured to be capable of being folded in such a manner as not to occupy a space at non-use (Patent Document 1).

PRIOR ART DOCUMENT

Patent Document

Patent Document 1: Japanese Patent Laid-Open No. 2005-146847 A

SUMMARY OF THE INVENTION

Incidentally, according to Patent Document 1, the operating pedal can be folded in a front-rear direction. The operating pedal in Patent Document 1, however, acts as a pedal for driving hydraulic actuators even in the folded state. Therefore, in the hydraulic excavator according to Patent Document 1, in a case of downsizing the operating peal and regulating the foot operation, it is necessary to put a cover or the like prepared separately on the operating pedal in a state where the operating pedal is folded, for example. Thereby, there is a problem that time and effort are required for the work of regulating the foot operation of the operating pedal.

The present invention is made in view of the aforementioned problems in the conventional art, and an object of the present invention is to provide a small-sized hydraulic excavator that can downsize an operating pedal by a simple movement and regulate a foot operation of the operating pedal.

A small-sized hydraulic excavator of a small revolving type according to the present invention comprises: an automotive lower traveling structure; an upper revolving structure that is supported through a revolving device on the lower traveling structure; and a front device that is tiltably mounted in the front side of the upper revolving structure in a front-rear direction, wherein the upper revolving structure includes: a revolving frame that is formed as a support structure; a counterweight that is mounted in the rear side of the revolving frame for acting as a weight balance to the front device; a prime mover that is positioned in the front side to the counterweight and is mounted on the revolving frame in a horizontal state of extending in a left-right direction to drive a hydraulic pump; an operator's seat stand that is provided on the revolving frame to cover the upper side of the prime mover and on which an operator's seat is mounted; and a floor member that is positioned in the front side of the operator's seat stand to be provided in the revolving frame and the left side in the left-right direction of which is an entrance way to the operator's seat, and at least the rear side of the upper revolving structure can revolve within a vehicle width of the lower traveling structure, wherein a pilot valve is provided in a front position of the floor member to control supply/discharge of a pilot pressure to a control valve device, an operating pedal that is positioned in the upper side to the floor member and is foot-operated in an upper-lower direction by an operator to perform the supply/discharge of the pilot pressure is provided with the pilot valve, the operating pedal includes: a first foot board that is mounted on the pilot valve to be rotatable in the upper-lower direction; a shaft that is provided in a rear position of the first foot board; and a second foot board that is mounted through the shaft to the first foot board to be rotatable in a horizontal direction and is rotated at the center of the shaft between a storage position of overlapping the first foot board in a lower surface side thereof and a use position of being rotated in the rear side of the first foot board, and an operation regulating mechanism is provided in the front side of the first foot board to regulate a foot operation to the operating pedal by engaging to the second foot board when the second foot board is rotated to the storage position.

According to the present invention, the operating pedal can be downsized by a simple movement and the foot operation of the operating pedal can be regulated.

MODE FOR CARRYING OUT THE INVENTION

Hereinafter, small-sized hydraulic excavators according to embodiments in the present invention will be in detail explained with reference to the accompanying drawings, by taking a small-sized hydraulic excavator of a super-small revolving type as an example.

Figure 1:
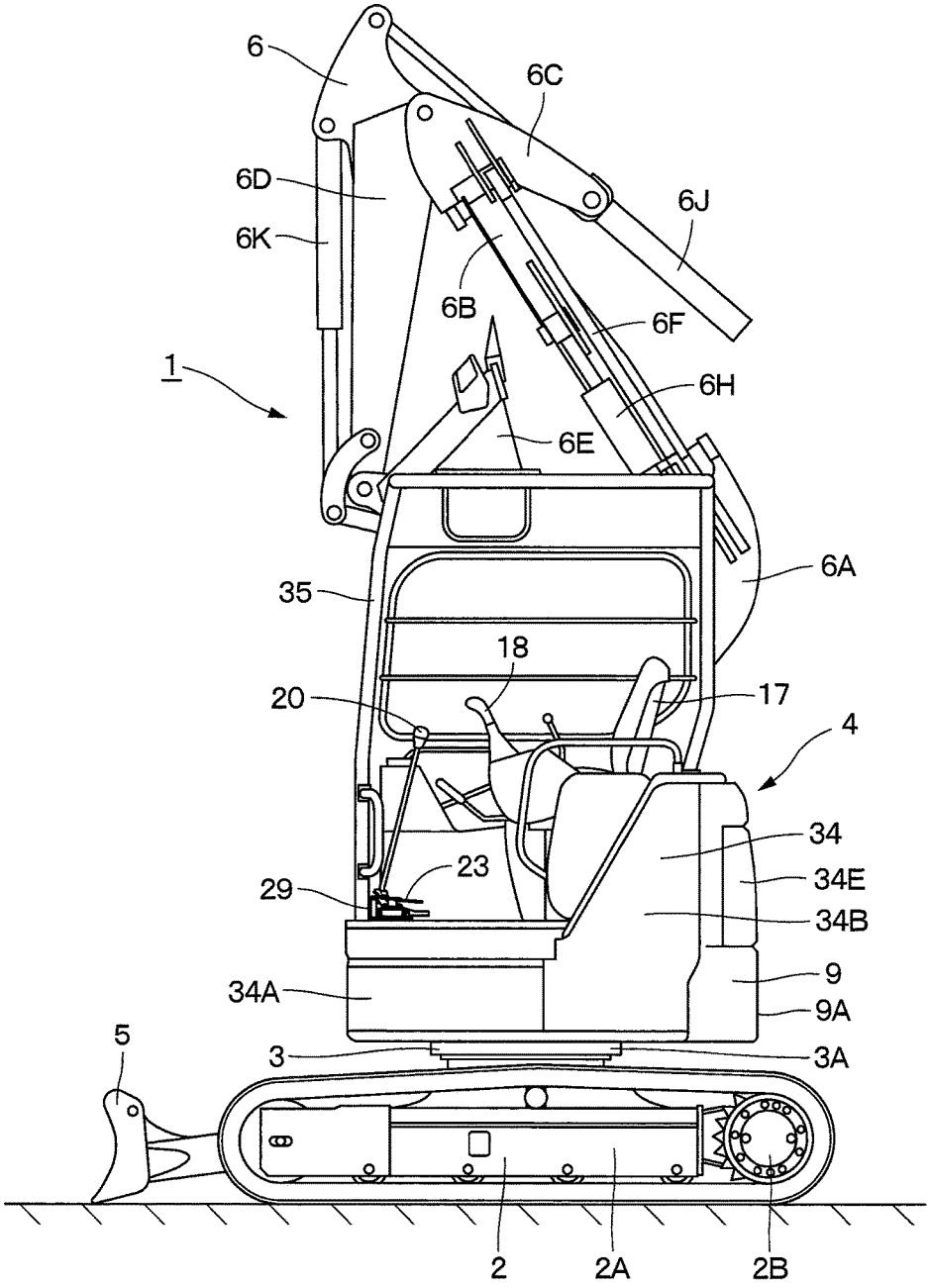
FIG. 1 is a front view showing a small-sized hydraulic excavator to be applied to a first embodiment in the present invention at a super-small revolving attitude.
Figure 2:
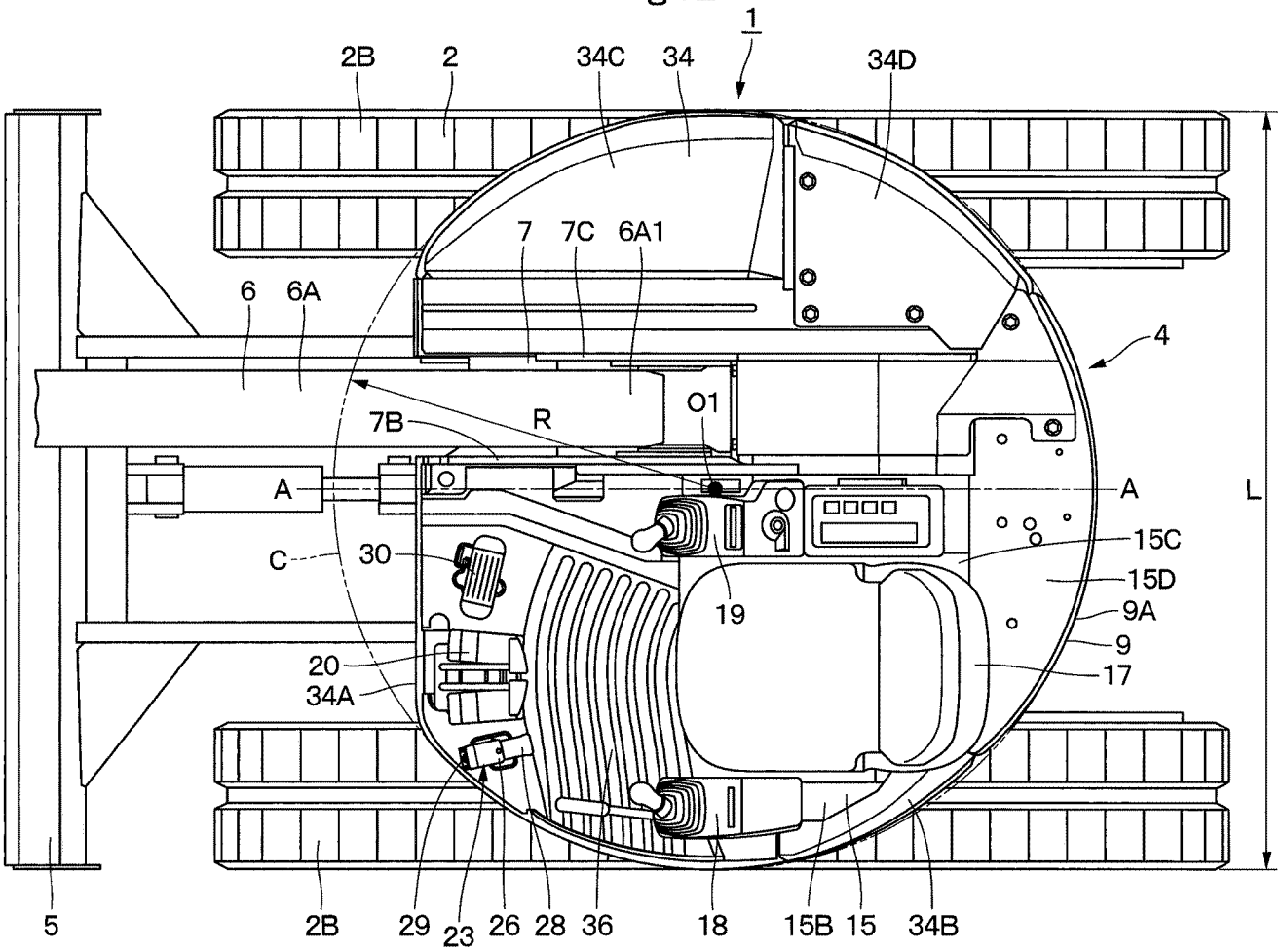
FIG. 2 is a plan view showing the small-sized hydraulic excavator in a state of removing a canopy as viewed from above.

FIG. 1 to FIG. 10 show a first embodiment of the present invention. In FIG. 1 and FIG. 2, a small-sized hydraulic excavator 1 of a super-small revolving type is used in an excavating operation in a narrow place for a ditch excavating operation or the like at the side of a road in an urban area, for example. In addition, for enabling the small-sized hydraulic excavator 1 to be transported by a general truck having a load capacity of less than 4 tons, a machinery weight thereof is set to approximately 0.8 to 4 tons, for example. The small-sized hydraulic excavator 1 includes an automotive lower traveling structure 2 provided with drive devices 2B of a crawl type in both of left and right sides of a truck frame 2A, an upper revolving structure 4 that is supported through a revolving device 3 on the lower traveling structure 2 to be capable of revolving thereon, a blade 5 that is provided in the front side of the lower traveling structure 2 and an offset front device 6 that is tiltably provided in the front side of the upper revolving structure 4 in a front-rear direction.

The revolving device 3 is configured of a revolving circle 3A that is provided between the lower traveling structure 2 and the upper revolving structure 4, and a revolving motor 3B (refer to FIG. 3) that drives/revolves the upper revolving structure 4. The revolving circle 3A is configured to connect an outer wheel mounted in a center frame 7A of a revolving frame 7 to be described later and an inner wheel mounted on the truck frame 2A of the lower traveling structure 2 to be rotatable through a plurality of steel balls. The revolving motor 3B is threaded with inner teeth provided on an inner peripheral side of the inner wheel through a pinion (any one is not shown).

The offset front device 6 includes a lower boom 6A a foot portion 6A1 of which is mounted to left and right front vertical plates 7B, 7C of the revolving frame 7 to be capable of lifting/tilting thereto, an upper boom 6B that is mounted to a tip side of the lower boom 6A to be capable of swinging in the left-right direction, an arm support body 6C that is mounted to a tip side of the upper boom 6B to be capable of swinging in the left-right direction, an arm 6D that is mounted to a tip side of the arm support body 6C to be rotatable in the upper-lower direction, a bucket 6E that is mounted to a tip side of the arm 6D to be rotatable in the upper-lower direction, a link 6F that establishes joint between the lower boom 6A and the arm support body 6C, and a boom cylinder 6G (refer to FIG. 3), an offset cylinder 6H, an arm cylinder 6J and a bucket cylinder 6K for operating the above components, which are described later.

Figure 3:
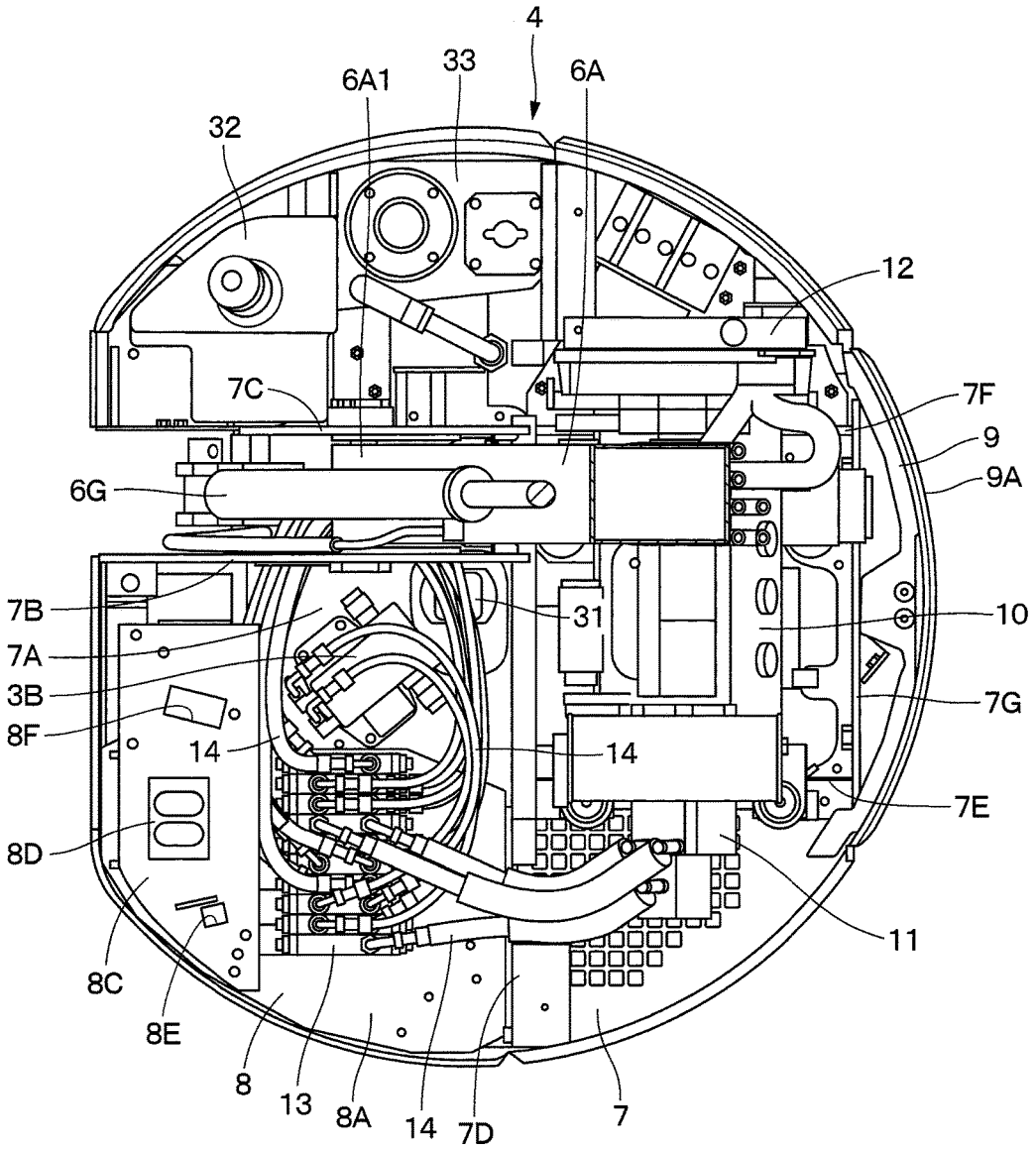
FIG. 3 is a plan view showing an upper revolving structure in a state of removing an operator's seat stand, a floor member, and various kinds of covers.

As shown in FIG. 3, the foot portion 6A1 of the lower boom 6A is positioned in the front side of the left and right front vertical plates 7B, 7C to be connected through connecting pins (not shown) to be rotatable thereto. Further, each of the cylinders 6G to 6K is connected through each of hydraulic hoses 14 to a control valve device 13 to be described later.

The offset front device 6 moves the arm 6D in parallel to the lower boom 6A in the left-right direction by expansion/contraction of the offset cylinder 6H. By lifting/tilting the lower boom 6A and rotating the arm 6D and the bucket 6E in this state, for example, it is possible to perform a ditch excavating operation.

Here, as shown in FIG. 1, the offset front device 6 tilts the tip side of the lower boom 6A to the most backward and folds the arm 6D to the lower boom 6A side, making it possible to take a super-small revolving attitude. In a state where the offset front device 6 is made in the super-small revolving attitude (in a state of being raised upward), when the upper revolving structure 4 is revolved, the upper revolving structure 4 and the offset front device 6 can fully revolve within a width dimension (vehicle width dimension) in the left-right direction and a length dimension in the front-rear direction of the lower traveling structure 2. In this case, as shown in FIG. 2, the vehicle width dimension of the lower traveling structure 2 is set by a width dimension L between the left and right drive devices 2B.

The upper revolving structure 4 includes the revolving frame 7, a counterweight 9, an engine 10, a hydraulic pump 11, a heat exchanger 12, an operator's seat stand 15, a floor member 16, a left side pilot valve 21, and a left side operating pedal 23 which will be described later.

Here, as shown in FIG. 2, the upper revolving structure 4 has a width dimension in the left-right direction approximately equal to the vehicle width dimension (width dimension L between the left and right drive devices 2B) of the lower traveling structure 2. On the other hand, an outer peripheral surface 9A of the counterweight 9 is formed in a circular shape as viewed from above in such a manner as to be accommodated within a virtual circle C having a revolving radius R at the center of a revolving center O1 of the upper revolving structure 4. Thereby, the small-sized hydraulic excavator 1 is configured such that the upper revolving structure 4 can revolve at the center of the revolving center O1 on the lower traveling structure 2 in a state of the super-small revolving attitude in which the offset front device 6 is raised upward. Accordingly, the hydraulic excavator 1 is configured as a hydraulic excavator of a super-small revolving type in which the upper revolving structure 4 together with the offset front device 6 is accommodated within the width dimension (vehicle width dimension) in the left-right direction and the length dimension in the front-rear direction of the lower traveling structure 2 or a part (for example, an outer edge of a floor configuring the operator's room) is partially slightly out of the above dimension in a range where any problem on the working does not occur but is substantially accommodated therein.

Next, an explanation will be made of the configuration of the revolving frame 7 formed as a support structure of the upper revolving structure 4 with reference to FIG. 3 and FIG. 4.

The revolving frame 7 acts as a base of the upper revolving structure 4, and is formed as a rigid support structure. The revolving frame 7 includes the flat plate-shaped center frame 7A on which an outer wheel of the revolving circle 3A configuring part of the revolving device 3 is mounted, the left front vertical plate 7B and the right front vertical plate 7C that are positioned in the front side from an intermediate portion of the center frame 7A in the front-rear direction and is provided to rise extending in the front-rear direction in a state of keeping a constant interval in the left-right direction on the center frame 7A, an intermediate lateral plate 7D that is provided to rise extending to the left in the front-rear direction from a rear end of the right front vertical plate 7C positioned in the intermediate portion of the center frame 7A in the front-rear direction, a left rear vertical plate 7E that is positioned in the vicinity of a left end of the center frame 7A and is provided to rise extending backward from the intermediate lateral plate 7D, a right rear vertical plate 7F that is provided to rise extending backward from the intermediate lateral plate 7D to be continuous to the rear side of the right front vertical plate 7C, a rear lateral plate 7G that is provided to rise extending in the left-right direction over rear ends of the left and right rear vertical plates 7E, 7F, and a floor support frame 8 to be described later.

The left and right front vertical plates 7B, 7C are arranged closer to the right side in the left-right direction than the revolving center O1 of the upper revolving structure 4. The foot portion 6A1 of the lower boom 6A is mounted to be capable of lifting/tilting on a section closer to the front side than the revolving center O1 among the left and right front vertical plates 7B, 7C. The intermediate lateral plate 7D is positioned closer to the rear side than the revolving center O1, is formed as a partition between the engine 10 and the control valve device 13 to be described later, and supports the front side of the operator's seat stand 15 to be described later.

The floor support frame 8 includes a lower plate 8A that a left end side of which is formed of a flat plate curved in an arc shape along the virtual circle C of the upper revolving structure 4, a column 8B that is formed of a vertical plate provided to rise in a front position of the lower plate 8A, and a lever/pedal mounting plate 8C provided to rise extending in the left-right direction on an upper portion of the column 8B.

The floor support frame 8 is provided with the lower plate 8A that is mounted on the upper side of the revolving frame 7. Thereby, in the floor support frame 8, the lower plate 8A configures a part of the center frame 7A in the revolving frame 7, and the lever/pedal mounting plate 8C configures a part of the floor member 16.

The lever/pedal mounting plate 8C of the floor support frame 8 is provided with a box-shaped mounting platform 8D that is positioned in the center in the left-right direction, and a left mounting opening 8E and a right mounting opening 8F that are arranged across the mounting platform 8D.

Here, the mounting platform 8D of the lever/pedal mounting plate 8C is provided with left and right traveling control levers/pedals 20, which will be described later, extending upward. In addition, the left mounting opening 8E is provided with the left side pilot valve 21 and the left side operating pedal 23 for operating an additional attachment (not shown). Further, the right mounting opening 8F is provided with a right side operating pedal 30 for performing an offset operation of the offset front device 6.

Next, a description will be made of members of the counterweight 9, the engine 10, the operator's seat stand 15, the floor member 16 and the like that are provided in the small-sized hydraulic excavator 1.

As shown in FIG. 1 and FIG. 2, the counterweight 9 is mounted on the rear side of the revolving frame 7 to act as a weight balance to the offset front device 6. The counterweight 9 is formed as an arc-shaped heavy weight a center of which in the left-right direction projects backward. As a result, an outer peripheral surface 9A of the counterweight 9 is formed as an arc surface that can be accommodated within the virtual circle C of the aforementioned revolving radius R.

The engine 10 as a prime mover is positioned in the front side to the counterweight 9 and is provided on the revolving frame 7. The engine 10 is positioned between the intermediate lateral plate 7D and the rear lateral plate 7G of the revolving frame 7 and is mounted in a horizontal state of extending in the left-right direction on the respective rear vertical plates 7E, 7F. The hydraulic pump 11 to be described later is arranged in the left side to the engine 10 to be described later. A cooling fan 10A (refer to FIG. 4) is provided in the right side of the engine 10.

The hydraulic pump 11 is provided on the left side to the engine 10 and is driven/rotated by the engine 10. The hydraulic pump 11 sucks hydraulic oil from the inside of a hydraulic oil tank 33 to be described later, and delivers the hydraulic oil as high-pressurized oil. The pressurized oil delivered from the hydraulic pump 11 is supplied, for example, to each of the cylinders 6G to 6K in the offset front device 6 through the control valve device 13 and each of hydraulic hoses 14.

As shown in FIG. 3, the heat exchanger 12 is provided on the revolving frame 7 to face the cooling fan 10A of the engine 10. The heat exchanger 12 includes a radiator and an oil cooler.

The control valve device 13 is provided on the lower plate 8A of the floor support frame 8. The control valve device 13 is positioned in the vicinity of the rear side of the lever/pedal mounting plate 8C and is configured by sequentially providing a plurality of control valves in the left-right direction. The control valve device 13 is respectively connected through a plurality of the hydraulic hoses 14 to the respective cylinders 6G to 6K of the offset front device 6, the drive devices 2B of the lower traveling structure 2, the revolving motor 3B in the revolving device 3 and the hydraulic pump 11.

The operator's seat stand 15 is positioned on the left side to the left front vertical plate 7B configuring the revolving frame 7 and is provided on the revolving frame 7 to cover the upper side of the engine 10. When a center line in the front-rear direction passing the revolving center O1 of the upper revolving structure 4 is indicated at A-A (refer to FIG. 2) , the operator's seat stand 15 is provided in a region reaching the left front vertical plate 7B over the centerline A-A and the circumference of the operator's seat stand 15 is set as a residential space of an operator. The small-sized hydraulic excavator 1 according to the present embodiment effectively utilizes a narrow region formed in the left side to the offset front device 6 of the upper revolving structure 4 at a maximum. Thereby, the small-sized hydraulic excavator 1 can secure the residential space of an operator set in the circumference of the operator's seat stand 15 as largely as possible.

Figure 4:
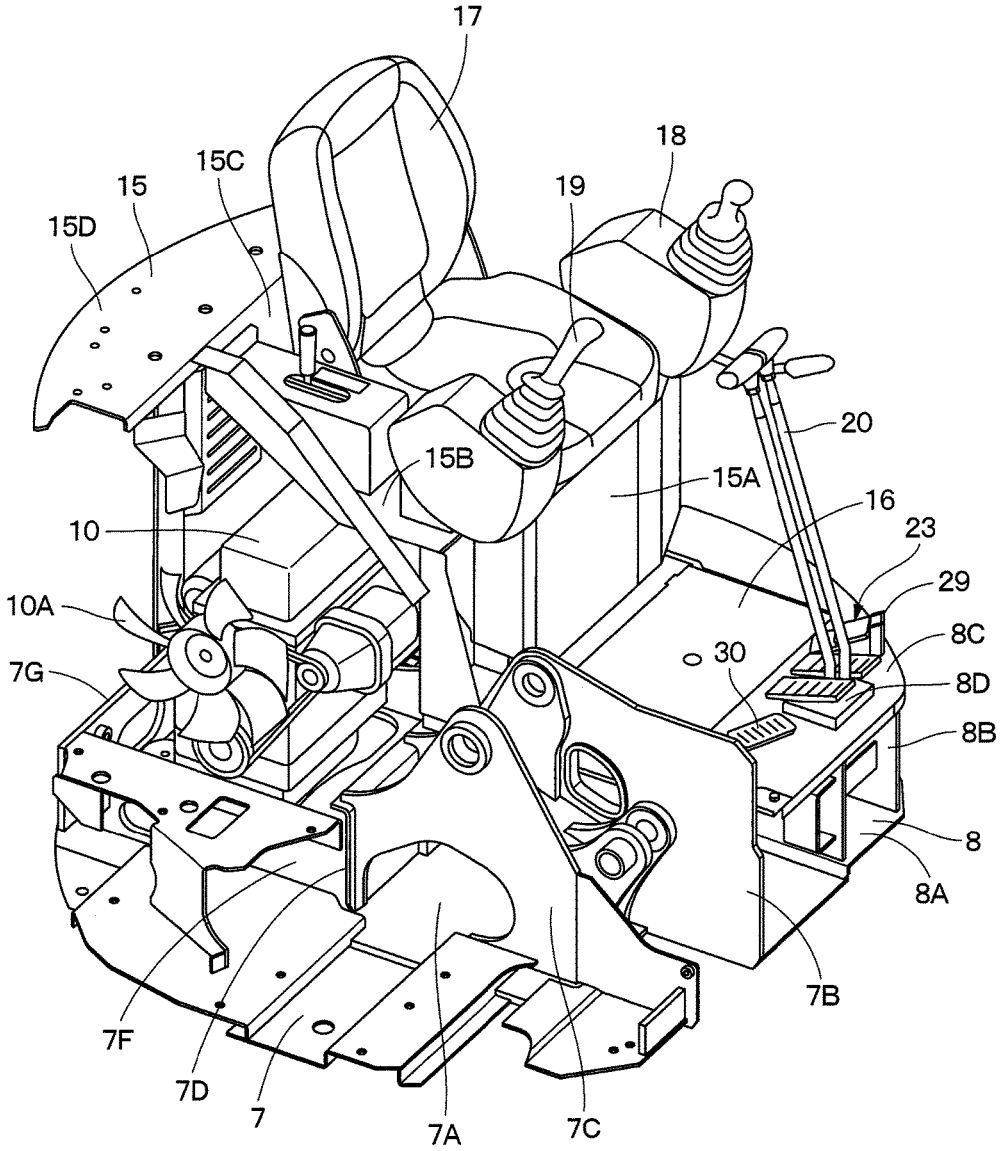
FIG. 4 is a perspective view showing a revolving frame, an engine, the operator's seat stand, an operator's seat, the floor member and operating pedals as viewed from the right front side.

Here, as shown in FIG. 4, the operator's seat stand 15 includes a front surface part 15A that is positioned on the intermediate lateral plate 7D of the revolving frame 7 and is provided to rise extending in the left-right direction, the operator's seat mounting part 15B that extends to the rear side from an upper portion of the front surface part 15A, a back plate part 15C inclined to an oblique upper side toward the rear side from a rear portion of the operator's seat mounting part 15B, and a weight abutting part 15D that extends to the rear side from an upper portion (rear portion) of the back plate part 15C to abut on an upper surface of the counterweight 9.

The operator's seat stand 15 is mounted in a state where a lower portion of the front surface part 15A is mounted on an upper portion of the intermediate lateral plate 7D of the revolving frame 7 and the weight abutting part 15D abuts on an upper surface of the counterweight 9. Thereby, the operator's seat stand 15 covers the front side and the upper side of the engine 10 and the hydraulic pump 11. The operator's seat 17, a left side front operating device 18, and a right side front operating device 19 to be described later are mounted on the operator's seat mounting part 15B of the operator's seat stand 15.

The floor member 16 is positioned in the front side of the operator' s seat stand 15 to be mounted on the revolving frame 7. In addition, the left side of the floor member 16 in the left-right direction is an entrance way to the operator's seat 17. The floor member 16 is formed by a rectangular flat plate extending in the left-right direction. The front side of the floor member 16 is mounted on the lever/pedal mounting plate 8C of the floor support frame 8, and the rear side thereof is mounted on a lower portion of the front surface part 15A of the operator's seat stand 15. The floor member 16 forms a foot step place of an operator in cooperation with the lever/pedal mounting plate 8C of the floor support frame 8.

Next, a description will made of the configuration of each of the operator's seat 17 on which an operator sits, and the left front side operating device 18, the right side front operating device 19 and a pair of the traveling control levers/pedals 20 which are operated by an operator.

Figure 5:
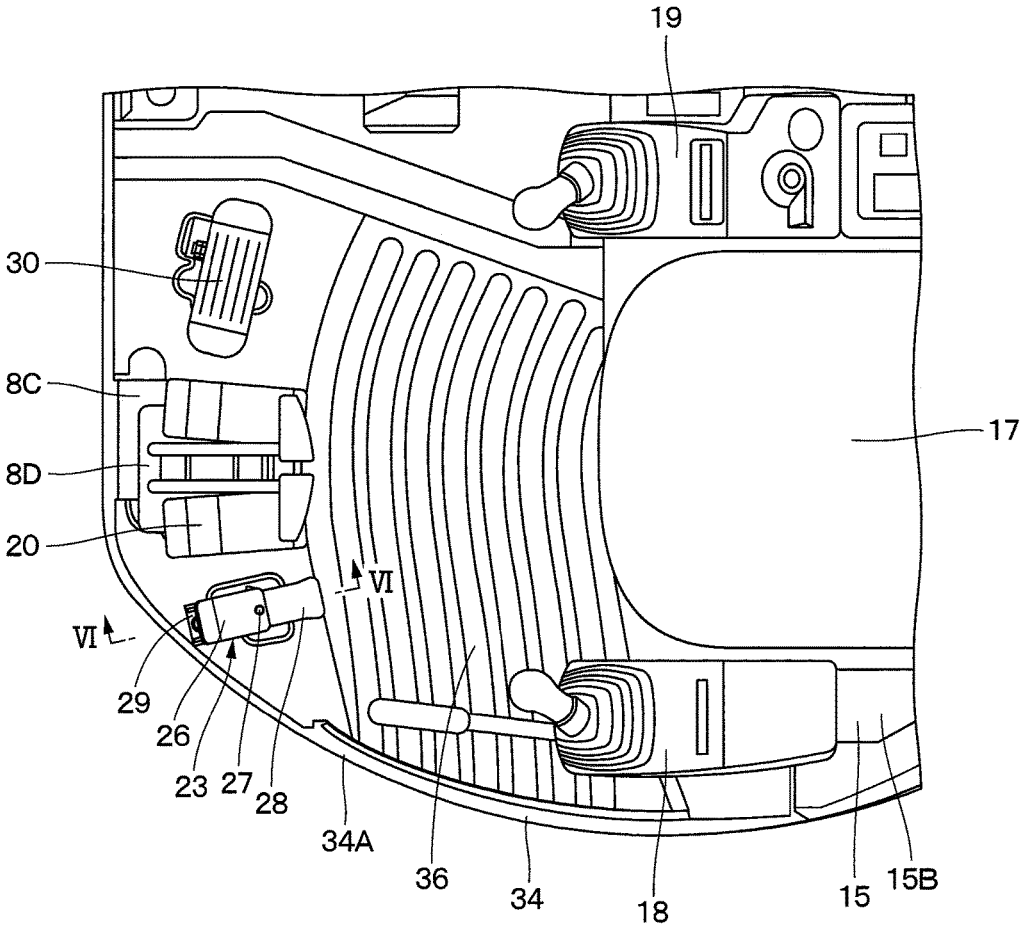
FIG. 5 is a plan view showing the operator's seat, the floor member, various kinds of operating levers and the operating pedals in FIG. 2 in an enlarging manner.

As shown in FIG. 2, FIG. 4 and FIG. 5, the operator's seat 17 is mounted on the operator's seat mounting part 15B of the operator's seat stand 15, and an operator sits on the operator's seat 17. The left side front operating device 18 and the right side front operating device 19 for operating the revolving device 3 and the offset front device 6 are provided on both of the left and right sides of the operator's seat 17.

A pair of the traveling control levers/pedals 20 are positioned in front of the operator's seat 17 to be provided on the lever/pedal mounting plate 8C of the floor supporting plate 8 configuring the front part of the floor member 16. The traveling control levers/pedals 20 control the drive devices 2B of the lower traveling structure 2 by performing the tilting operation in the front-rear direction.

Next, an explanation will be in detail made of the configuration of each of the left side pilot valve 21 (hereinafter, referred to as "pilot valve 21" simply) and the left side operating pedal 23 (hereinafter, referred to as "operating pedal 23" simply) that are positioned in the left side as a characteristic part of the present invention with reference to FIG. 5 to FIG. 10.

Figure 6:
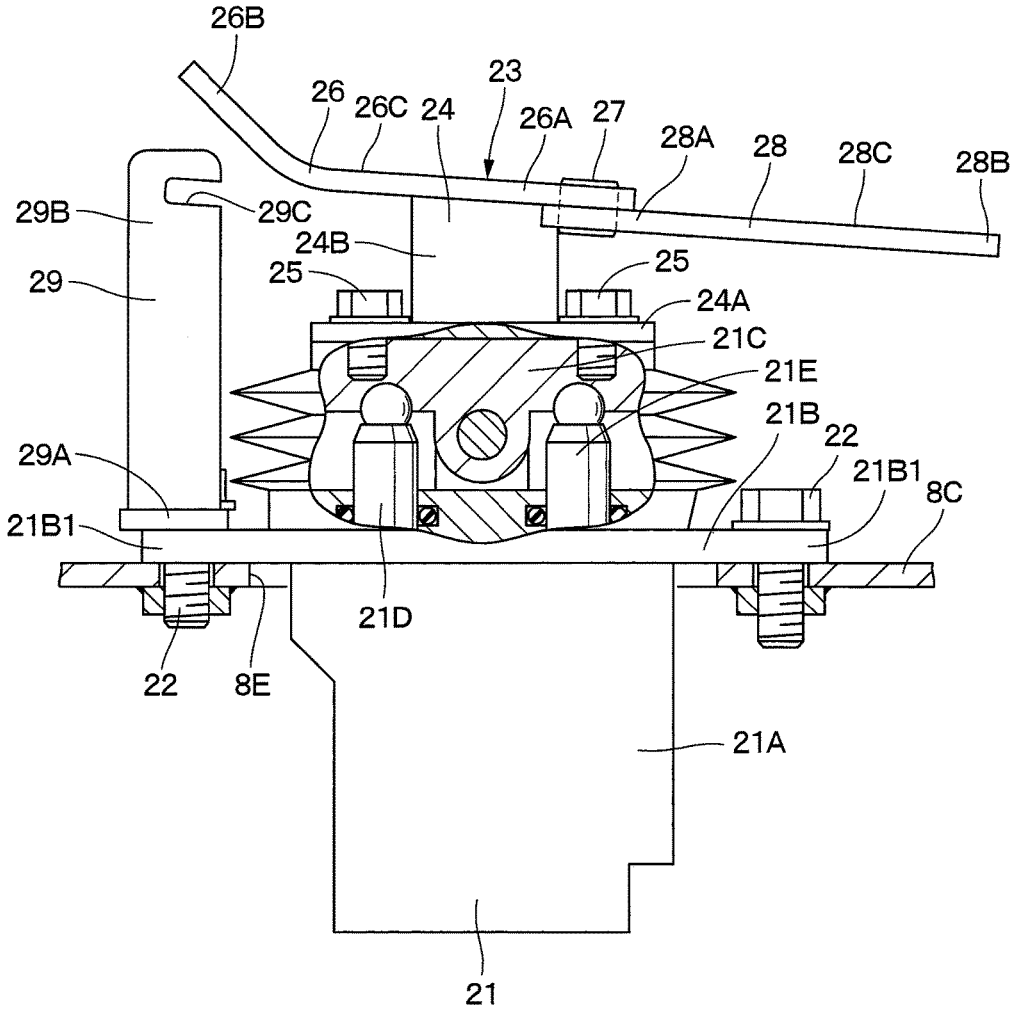
FIG. 6 is an enlarged cross sectional view showing a part of a lever/pedal mounting plate, a pilot valve, the operating pedal and an operation regulating mechanism as viewed in a direction of arrows VI-VI in FIG. 5.

As shown in FIG. 5 and FIG. 6, the pilot valve 21 is provided in the front position of the floor member 16, that is, the position suitable for putting the feet when the operator has seated on the operator's seat 17. Specifically, the pilot valve 21 is provided on the lever/pedal mounting plate 8C in a state of being inserted in the left mounting opening 8E of the floor support frame 8. The pilot valve 21 controls supply/discharge of a pilot pressure to the control valve device 13. The pilot valve 21 is a pilot valve of a pressure reducing valve type that is mounted on the lever/pedal mounting plate 8C. The pilot valve 21 includes a casing 21A in a flat cuboid shape in the left-right direction, a lid member 21B provided on an upper portion side of the casing 21A, a pedal mounting plate 21C provided on the upper side of the lid member 21B to be rotatable in the upper-lower direction, and a pair of pushers 21D, 21E that are provided to be spaced in the front-rear direction in the casing 21A and the lid member 21B and move in the upper-lower direction by the pedal mounting plate 21C.

Mounting flanges 21B1 are respectively provided in the lid member 21B to project in the front-rear direction, and the respective mounting flanges 21B1 are mounted on the lever/pedal mounting plate 8C using bolts 22. Thereby, the lid member 21B in the pilot valve 21 is arranged to project in the upper side from the lever/pedal mounting plate 8C.

In addition, when the operating pedal 23 to be described later is foot-operated to rotate in the upper-lower direction, each of the pushers 21D, 21E is displaced axially, and thereby the pilot valve 21 outputs a hydraulic pilot signal to a control valve for supplying/discharging pressurized oil to an additional attachment such as a grapple. Thereby, the pressurized oil to the grapple from the hydraulic pump 11 is supplied/discharged in response to a foot operation of the operating pedal 23.

The operating pedal 23 is provided in an upper part of the pilot valve 21. The operating pedal 23 is positioned in the upper side to the lever/pedal mounting plate 8C and is foot-operated in the upper-lower direction by an operator to perform supply/discharge of the pilot pressure to the additional attachment of the grapple or the like. The operating pedal 23 includes a mounting bracket 24, a first foot board 26, a shaft 27 and a second foot board 28, which will be described later.

The mounting bracket 24 configures a part of the first foot board 26, and is mounted on the pedal mounting plate 21C of the pilot valve 21. Specifically, the mounting bracket 24 includes a mounting plate portion 24A formed of a rectangular flat plate body that is mounted on an upper surface of the pedal mounting plate 21C using bolts 25, and a vertical support plate 24B that is curved and extends upward from an intermediate portion in the front-rear direction in a right end edge of the mounting plate portion 24A. Here, the vertical support plate 24B abuts on an end edge of the second foot board 28 to be described later when the second foot board 28 is rotated toward the storage position, thus having a function of positioning the second foot board 28 to the storage position.

The first foot board 26 is formed of a rectangular plate body that is elongated in the front-rear direction, and is mounted in an upper position of the vertical support plate 24B in a state of facing the upper side of the mounting plate portion 24A.

Thereby, the first foot board 26 is mounted on the pilot valve 21 through the mounting bracket 24 to be rotatable in the upper-lower direction. The first foot board 26 is configured of a flat plate portion 26A in a wide range from an intermediate portion to the rear side in the front-rear direction, and an inclined plate portion 26B that is bent and extends obliquely upward from a front end portion of the flat plate portion 26A.

The first foot board 26 has an upper surface that acts as a tread 26C, and a left foot of an operator who has been seated on the operator's seat 17 is placed on the tread 26C. The flat plate portion 26A of the first foot board 26 is inclined such that the front side is higher than the rear side for an operator who has been seated on the operator's seat 17 to be able to place the left foot thereon in a comfortable attitude. In this case, an inclination angle of the flat plate portion 26A is a slight inclination degree, and the second foot board 28 to be described later results in rotating in a horizontal direction in a state of being inclined slightly.

The shaft 27 is provided in a rear position of the first foot board 26. The shaft 27 penetrates the first foot board 26 in the plate thickness direction to project to a lower side therefrom. A mounting portion 28A of the second foot board 28 is mounted on a projecting end of the shaft 27. Thereby, the shaft 27 supports the second foot board 28 in the rear side of the first foot board 26 to be rotatable in a horizontal direction.

The second foot board 28 is mounted through the shaft 27 on the first foot board 26 to be rotatable in the horizontal direction. The second foot board 28 is formed as an approximately rectangular flat plate body having a width dimension as approximately similar to a width dimension of the first footboard 26. One side of the second foot board 28 in a length direction projects in a mountain shape to be formed as the mounting portion 28A. The mounting portion 28A is mounted through the shaft 27 in the rear position of the flat plate portion 26A in the first foot board 26 to be rotatable in the horizontal direction. The other side of the second foot board 28 in the length direction is formed as a rectangular-shaped free end portion 28B.

Figure 9:
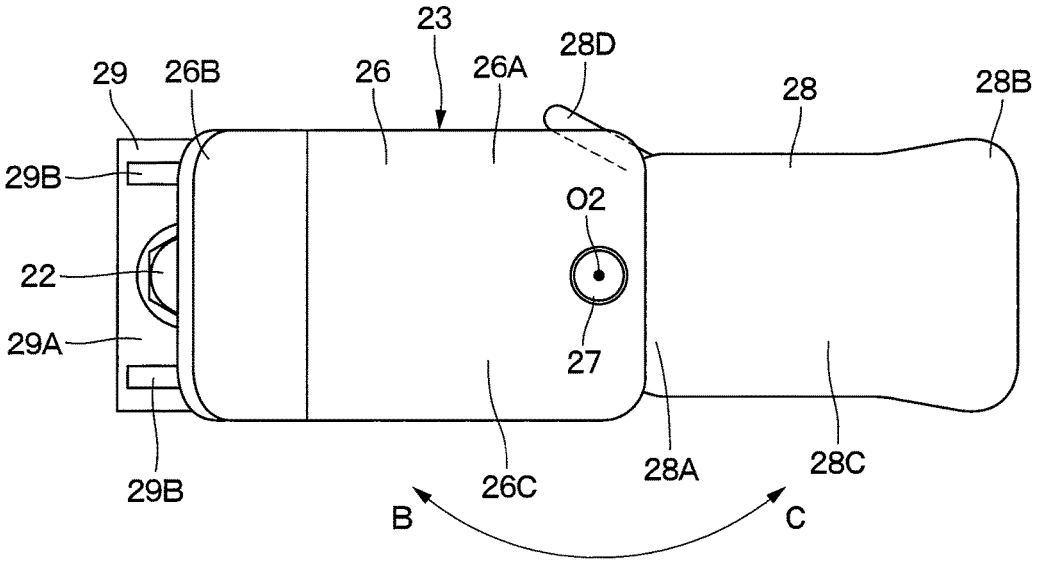
FIG. 9 is a plan view showing the pilot valve, the operating pedal and the operation regulating mechanism as viewed from above.

As shown in FIG. 9, the second foot board 28 is provided to be rotatable at the center of an axis line O2 of the shaft 27. The second foot board 28 can be arranged in the storage position of overlapping the first foot board 26 in a lower surface side thereof by rotation of the second foot board 28 in a direction of an arrow B in FIG. 9. On the other hand, the second foot board 28 can be arranged in a use position of extending to the rear side of the first foot board 26 by rotation of the second foot board 28 in a direction of an arrow C in FIG. 9 from the storage position. In this use position, an upper surface of the second foot board 28 also can form a tread 28C together with the tread 26C of the first foot board 26.

Figure 10:
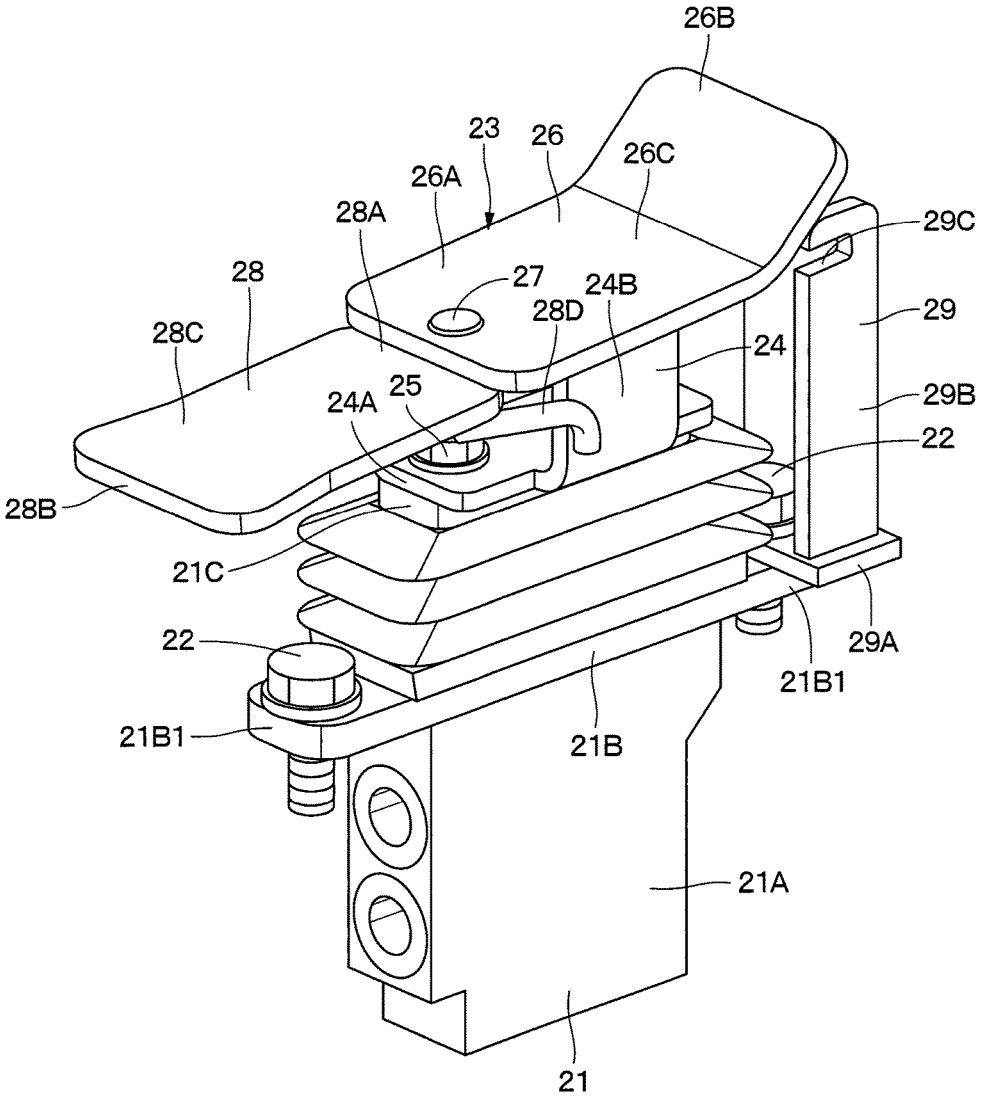
FIG. 10 is a perspective view showing the pilot valve, the operating pedal and the operation regulating mechanism as viewed from the right rear side.

In addition, as shown in FIG. 10, the second foot board 28 is provided with a positioning member 28D that extends in an oblique front side in a position of abutting on the vertical support plate 24B of the mounting bracket 24 in the use position, that is, in a corner portion position in the right front side. The positioning member 28D abuts on the vertical support plate 24B of the mounting bracket 24 at the time of setting the second foot board 28 to the use position to position the second foot board 28 to the use position.

Next, an explanation will be in detail made of the configuration and function of an operation regulating mechanism 29 that is a characteristic part of the present invention.

Figure 8:
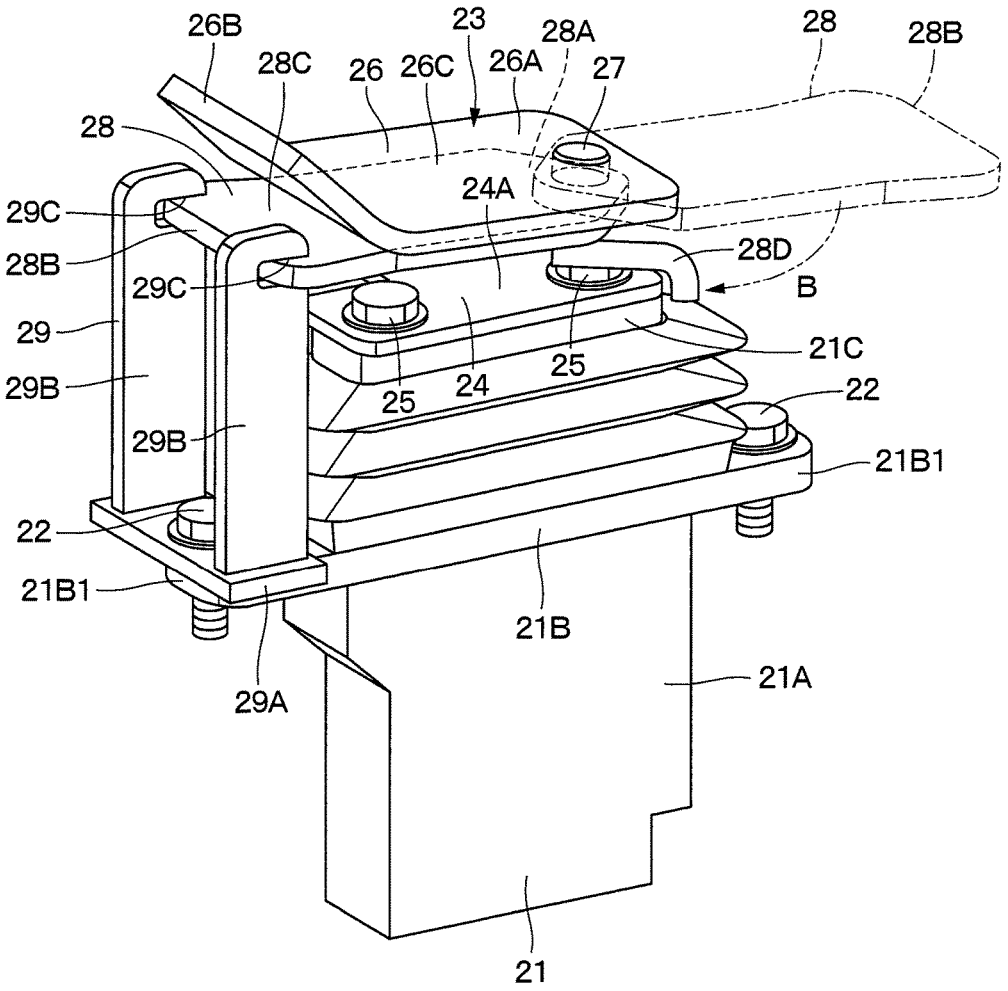
FIG. 8 is a perspective view showing the pilot valve, the operating pedal and the operation regulating mechanism as viewed from a position as similar to FIG. 7 in a state of arranging a second foot board in a storage position.

The operation regulating mechanism 29 is provided in front of the first foot board 26, specifically, in a front mounting flange 21B1 configuring part of the lid member 21B in the pilot valve 21. As shown in FIG. 8, the operation regulating mechanism 29 is engaged to the free end portion 28B of the second foot board 28 when the second foot board 28 is rotated to the storage position, thereby regulating the foot operation to the operating pedal 23.

The operation regulating mechanism 29 is formed by a rectangular base member 29A that is mounted on the front mounting flange 21B1 by jointly fastening by bolts 22 or by mounting means including welding, and two rising members 29B rising from an upper surface of the base member 29A to be spaced in the left-right direction. A slit portion 29C is provided in an upper position of each of the rising members 29B to regulate a foot operation to the operating pedal 23 by engagement of the free end portion 28B of the second foot board 28 when the second foot board 28 is rotated to the storage position.

When the second foot board 28 is arranged in the storage position, since the second foot board 28 overlaps the flat plate portion 26A of the first foot board 26 in parallel thereto, the second foot board 28 becomes in a state of being inclined such that the front side is higher than the rear side as similar to the flat plate portion 26A. Accordingly, for horizontally inserting therein the free end portion 28B arranged in the front side, each of the slit portions 29C is formed as a notch groove that has a gap dimension slightly larger than the plate thickness dimension of the second foot board 28 and opens to be inclined slightly downward toward the rear side.

In this case, since the rising member 29B provided with the slit portion 29C comprises two members provided to be spaced in the left-right direction, the rising members 29B can stably support the second foot board 28 such that the second foot board 28 is not twisted upon applying a load thereon by a foot. It should be noted that the rising member 29B provided with the slit portion 29C may comprise one member.

As shown in FIG. 5, the right side operating pedal 30 positioned in the right side is provided in a right position to the lever/pedal mounting plate 8C of the floor support frame 8.

The right side operating pedal 30 is, as similar to the left side operating pedal 23, provided in the upper part of the right pilot valve (not shown) provided in the right mounting opening 8F. The right side operating pedal 30 performs, for example, supply/discharge of a pilot pressure to the offset cylinder 6H for performing an offset operation of the offset front device 6 in the left-right direction by a foot operation in the upper-lower direction by an operator.

It should be noted that the right side operating pedal 30 is arranged in a lateral direction to be longer in the left-right direction to respond to an offset operation of the offset front device 6 in the left-right direction, and the left side or right side of the right side operating pedal 30 is depressed to perform the offset operation of the offset front device 6 in the left or right direction. Since the laterally arranged right side operating pedal 30 does not project to the operator's seat 17 side, an operator can put the right foot on a floor mat 36 safely.

As shown in FIG. 3, a center joint 31 is provided in the revolving center O1 of the upper revolving structure 4. The center joint 31 causes pressurized oil to flow between the lower traveling structure 2 and the upper revolving structure 4. The center joint 31 is mounted in the central position of the truck frame 2A configuring part of the lower traveling structure 2.

A fuel tank 32 is positioned in the right side to the foot portion 6A1 of the offset front device 6 to be mounted on the revolving frame 7. The fuel tank 32 reserves therein fuel to be supplied to the engine 10.

A hydraulic oil tank 33 is positioned in the right side to the foot portion 6A1 of the offset front device 6 to be mounted on the revolving frame 7. The hydraulic oil tank 33 reserves therein hydraulic oil to be supplied to the hydraulic actuators including each of the cylinders 6G to 6K in the offset front device 6, the traveling motor of the lower traveling structure 2 and the revolving motor 3B of the revolving device 3.

As shown in FIG. 1 and FIG. 2, an exterior cover 34 includes a left front cover portion 34A that covers the left side from the front side of the floor support frame 8 configuring part of the revolving frame 7, a left rear cover portion 34B that covers between the left front cover portion 34A and the counterweight 9, a tank cover portion 34C that covers the fuel tank 32, the hydraulic oil tank 33 and the like, a heat exchanger cover portion 34D that is positioned in the rear side to the tank cover portion 34C to cover the heat exchanger 12 and the like, and an engine cover portion 34E that is provided in the counterweight 9 for maintenance of the engine 10 to be capable of opening/closing.

A canopy 35 is provided on the upper side of the revolving frame 7 and the counterweight 9 to cover the upper side and the right lateral side of the operator's seat 17. The canopy 35 is configured as a canopy of a 3-post type, for example. It should be noted that a rear end of the canopy 35 is fixed on the counterweight 9 together with the operator's seat stand 15 in a position of the weight abutting part 15D of the operator's seat stand 15. In addition, the floor mat 36 is provided to cover the upper side of the lever/pedal mounting plate 8C of the floor support frame 8 and the floor member 16.

The small-sized hydraulic excavator 1 of the super-small revolving type according to the first embodiment has the configuration as described above, and next, an operation thereof will be explained.

First, an operator gets in the floor member 16 and sits on the operator's seat 17. The operator who has been seated on the operator's seat 17 operates the pair of the traveling control levers/pedals 20, making it possible to cause the lower traveling structure 2 to travel. On the other hand, the operator performs a lever operation to the left side front operating device 18 or the right side front operating device 19, making it possible to perform the revolving operation of the upper revolving structure 4 and the excavating operation of earth and sand by the offset front device 6.

In this case, the small-sized hydraulic excavator 1 of the super-small revolving type sets the offset front device 6 to a super-small revolving attitude shown in FIG. 1, thus making it possible to fully revolve the upper revolving structure 4 and the offset front device 6 within the width dimension (vehicle width dimension L) in the left-right direction and within the length dimension in the front-rear direction of the lower traveling structure 2. Thereby, the small-sized hydraulic excavator 1 can smoothly perform a ditch digging operation using the offset front device 6 without interference with obstacles in the circumference also in the narrow working site of the urban area.

Next, a description will be made of a work (operation) in a case of operating the grapple as the additional attachment by the left side operating pedal 23.

In the small-sized hydraulic excavator 1 of the super-small revolving type, the upper revolving structure 4 is formed in a compact manner such that the upper revolving structure 4 can fully revolve within the width dimension L of the lower traveling structure 2 in the left-right direction, and therefore, a foot space becomes narrow when an operator sits on the operator's seat 17. Particularly, in the small-sized hydraulic excavator 1 of the super-small revolving type in which the offset front device 6 is arranged in the right side to the operator's seat 17, the foot space is narrower by a size of the offset front device 6. Accordingly, the foot space is widened by folding the operating pedal 23 in the front-rear direction at a non-use time the grapple is not provided.

Figure 7:
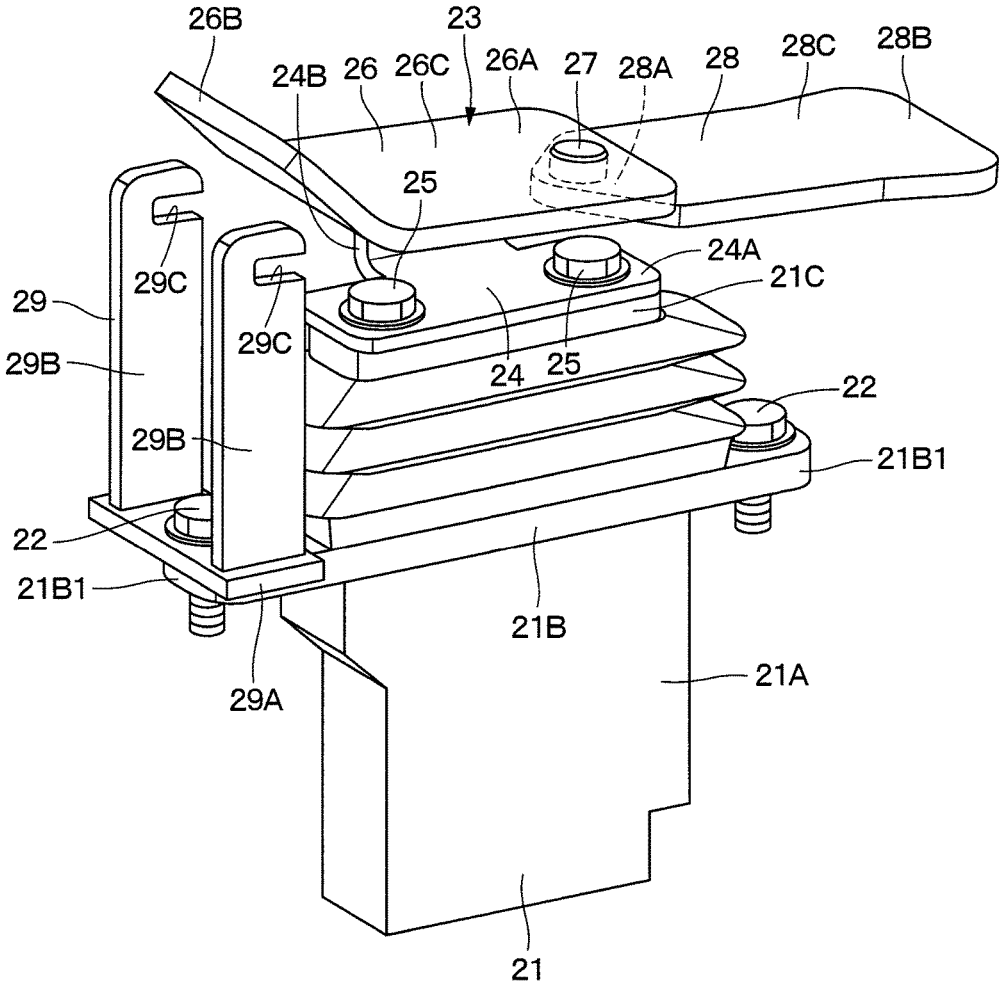
FIG. 7 is a perspective view showing the pilot valve, the operating pedal and the operation regulating mechanism shown in FIG. 6 as viewed from the left front side.

In a case of operating the grapple by using the operating pedal 23, it is necessary to pull the second foot board 28 stored in the lower surface side of the first foot board 26 to be arranged in the use position. Therefore, the second foot board 28 stored in the lower surface side of the first foot board 26 is rotated in a direction of an arrow C in FIG. 9 at the center of the shaft 27 (axis line O2). Thereby, as shown in FIG. 7 and FIG. 10, the second foot board 28 can be pulled to be arranged in the use position. In addition, when the second footboard 28 is arranged in the use position, the second foot board 28 can be positioned in the use position by abutment of the positioning member 28D on the vertical support plate 24B of the mounting bracket 24.

When the second foot board 28 is arranged in the use position, a left foot is put on the treads 26C, 28C of the respective foot boards 26, 28 to perform the foot operation in the upper-lower direction. Thereby, a hydraulic pilot signal is outputted to a switch valve that performs supply/discharge of pressurized oil to the grapple, making it possible to operate the grapple in response to the foot operation.

Next, an explanation will be made of the operation at the time of storing the second foot board 28 that has been used. As shown in FIG. 9, the second foot board 28 is rotated in a direction of an arrow B at the center of the shaft 27 (axis line O2). Thereby, as shown in FIG. 8, the second foot board 28 can be stored in the lower surface side of the first foot board 26 to be overlapped thereon. In the storage state of the second foot board 28, it is possible to widen the foot space of an operator.

In addition, in a state where the second foot board 28 is stored in the lower surface side of the first foot board 26 to be overlapped thereon, the free end portion 28B of the second foot board 28 is engaged to the slit portion 29C provided in each of the rising members 29B of the operation regulating mechanism 29. Thereby, the operation regulating mechanism 29 can fix the first foot board 26 and the second foot board 28 in the upper-lower direction (pedal operating direction) to regulate the foot operation to the operating pedal 23. In this state, the operating pedal 23 can be used as a foot rest for putting a foot thereon.

In this way, according to the first embodiment, the pilot valve 21 is provided in the front position of the floor member 16, that is, the position suitable for putting the feet when the operator has seated on the operator's seat 17. Specifically, the pilot valve 21 that controls supply/discharge of a pilot pressure to the control valve device 13 is provided at the position of the lever/pedal mounting plate 8C of the floor support frame 8. The pilot valve 21 is provided with the operating pedal 23 that is positioned in the upper side to the lever/pedal mounting plate 8C and performs the supply/discharge of the pilot pressure by the foot operation thereto in the upper-lower direction by an operator. On the other hand, the operating pedal 23 is configured of the first foot board 26 that is mounted on the pilot valve 21 to be rotatable in the upper-lower direction, the shaft 27 that is mounted in the rear position of the first foot board 26, and the second foot board 28 that is mounted through the shaft 27 on the first foot board 26 to be rotatable in the horizontal direction. In addition, the second foot board 28 can rotate at the center of the shaft 27 between the storage position of overlapping the first foot board 26 in the lower surface side thereof and the use position of being rotated to the rear side of the first foot board 26. In addition thereto, the operation regulating mechanism 29 is provided in the front side to the first foot board 26, wherein the operation regulating mechanism 29 regulates the foot operation to the operating pedal 23 by the engagement to the second foot board 28 when the second foot board 28 is rotated to the storage position.

Accordingly, by rotating the second foot board 28 at the center of the shaft 27, as shown in FIG. 8, the second footboard 28 can be stored in the lower surface side of the first foot board 26 to be overlapped thereon. In the storage position of the second foot board 28, it is possible to widen the foot space of an operator.

In addition, in a state where the second foot board 28 is stored, the free end portion 28B of the second foot board 28 can be engaged to the operation regulating mechanism 29. Thereby, the operation regulating mechanism 29 can fix the first footboard 26 and the second foot board 28 in the upper-lower direction to regulate the foot operation to the operating pedal 23. In this state, the operating pedal 23 can be used as a footrest for putting a foot thereon.

In a case of not using the additional attachment, it is possible to fold the operating pedal 23 in a simple work for compactification, and the foot operation of the operating pedal 23 can be regulated.

In addition, the second foot board 28 includes the mounting portion 28A that is positioned in one side of the second foot board 28 in the length direction and is mounted through the shaft 27 on the first foot board 26 to be rotatable thereto, and the free end portion 28B that is positioned in the other side thereof in the length direction. On the other hand, the operation regulating mechanism 29 is formed of the rising members 29B that are mounted and risen on the pilot valve 21, and the rising members 29B of the operation regulating mechanism 29 are provided with the slit portions 29C, to which the free end portion 28B of the second foot board 28 is engaged when the second foot board 28 is rotated to the storage position. Thereby, in a state of engaging the free end portion 28B of the second foot board 28 to the slit portions 29C in the operation regulating mechanism 29, the foot operation to the operating pedal 23 can be regulated.

Figure 11:
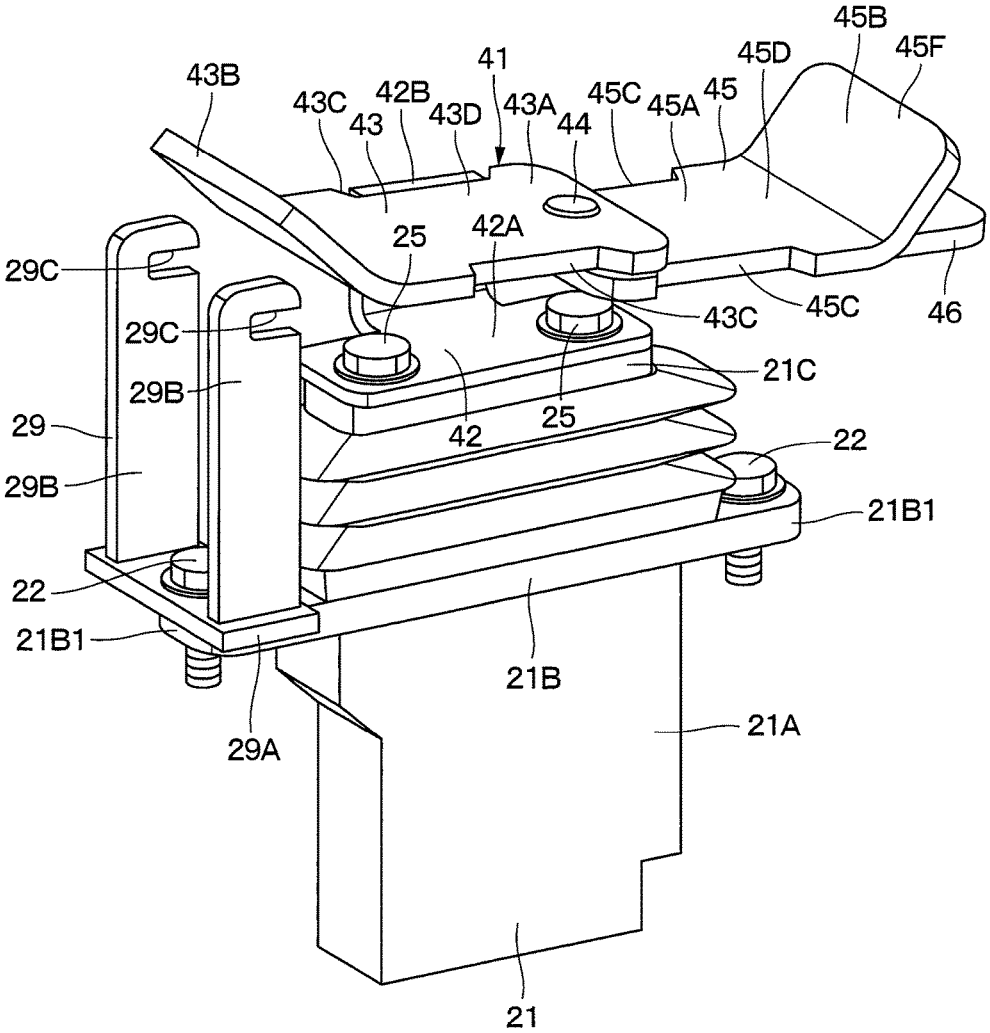
FIG. 11 is a perspective view showing an operating pedal provided with a second foot board according to a second embodiment together with a pilot valve and an operation regulating mechanism as viewed from a position as similar to FIG. 7.
Figure 12:
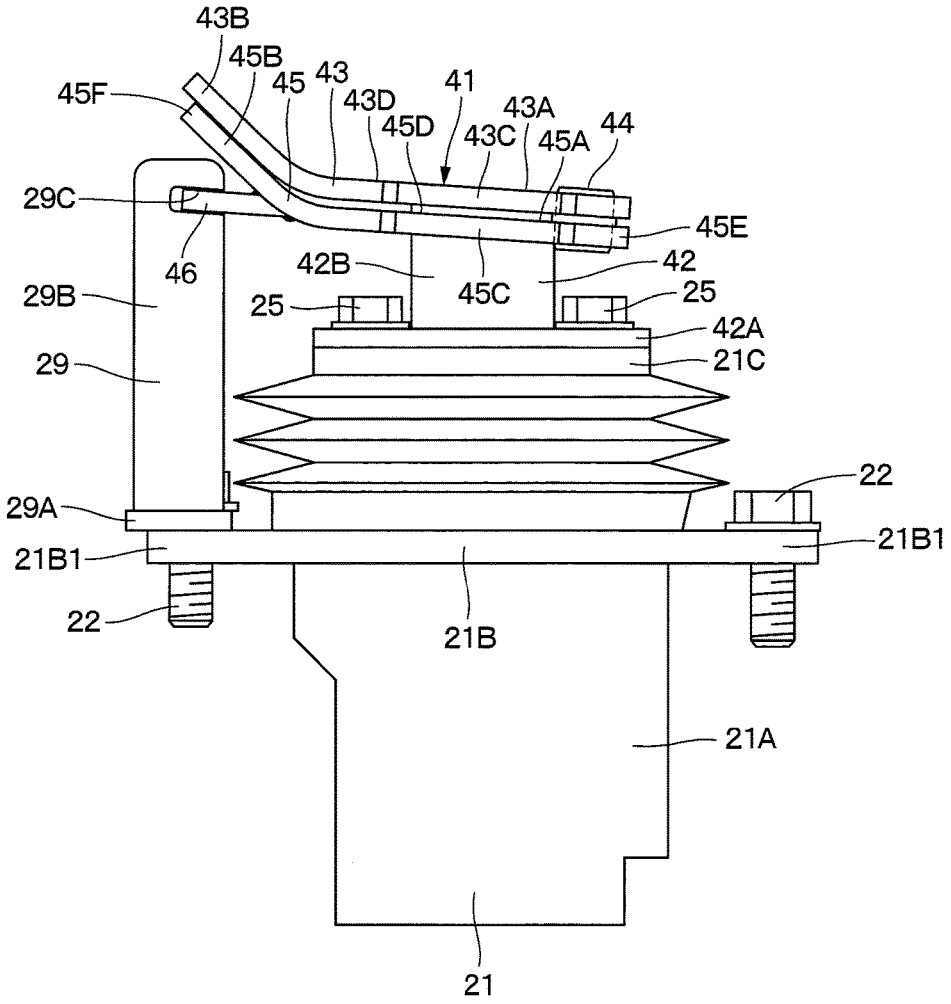
FIG. 12 is a front view showing the pilot valve, the operating pedal and the operation regulating mechanism in FIG. 11.

Next, FIG. 11 and FIG. 12 show a second embodiment of the present invention. The present embodiment is characterized in that a first foot board and a second foot board each are formed by using a plate body having an identical shape. It should be noted that in the present embodiment, components identical to those in the first embodiment as described above are referred to as identical reference numerals and an explanation thereof is omitted.

In FIG. 11, a left side operating pedal 41 (hereinafter, referred to as "operating pedal 41" simply) positioned in the left side according to the second embodiment includes, as approximately similar to the operating pedal 23 according to the first embodiment, a mounting bracket 42, a first foot board 43, a shaft 44 and a second foot board 45.

The mounting bracket 42 configures, as approximately similar to the mounting bracket 24 according to the first embodiment, apart of the first foot board 43, and is configured of a mounting plate portion 42A and a vertical support plate 42B. The first foot board 43 is mounted on an upper position of the vertical support plate 42B to face the upper side of the mounting plate portion 42A.

The first foot board 43 is configured of, as approximately similar to the first foot board 26 according to the first embodiment, a flat plate portion 43A and an inclined plate portion 43B. Recessed portions 43C in a stepped shape are provided on left and right side edges of the flat plate portion 43A to extend in the front-rear direction. In addition, an upper surface of the first foot board 43 is formed as a tread 43D. In the first foot board 43, the right recessed portion 43C is fixed to an upper portion of the vertical support plate 42B in the mounting bracket 42 by using welding means, for example.

The shaft 44 is provided in a rear position of the first foot board 43 to penetrate in a plate thickness direction, for example. The shaft 44 supports the second foot board 45 in the rear side of the first foot board 43 to be rotatable in a horizontal direction.

The second foot board 45 is mounted through the shaft 44 to the first foot board 43 to be rotatable in the horizontal direction. The second foot board 45 is formed by using a plate body having a shape identical to the first foot board 43. That is, the second foot board 45 is formed of, as similar to the first foot board 43, a flat plate portion 45A, an inclined plate portion 45B, recessed portions 45C and a tread 45D. Therefore, the first foot board 43 and the second foot board 45 can be formed using the same material. An end of the second foot board 45 in the flat plate portion 45A side becomes a mounting portion 45E, and the inclined plate portion 45B side thereof becomes a free end portion 45F.

On the other hand, an engagement plate 46 is fixed on the second foot board 45 to be positioned in a root section (end of the flat plate portion 45A side) of the inclined plate portion 45B. The engagement plate 46 configures a free end portion that is engaged to the operation regulating mechanism 29 in the second foot board 45. As shown in FIG. 12, when the second foot board 45 is rotated forward at the center of the shaft 44, it is possible to store the second foot board 45 in the lower surface side of the first foot board 43. In this state, the second foot board 45 can cause the engagement plate 46 to be engaged to each of the slit portions 29C in the operation regulating mechanism 29 in the storage position. Thereby, the foot operation to the operating pedal 41 can be regulated.

In this way, also the second embodiment as configured above can obtain functions and effects as approximately similar to those in the first embodiment as described before. Particularly, in the second embodiment, the first foot board 43 and the second foot board 45 each are formed using a plate body having an identical shape. Thereby, components for forming the operating pedal 41 can be communalized to reduce manufacturing costs.

Figure 13:
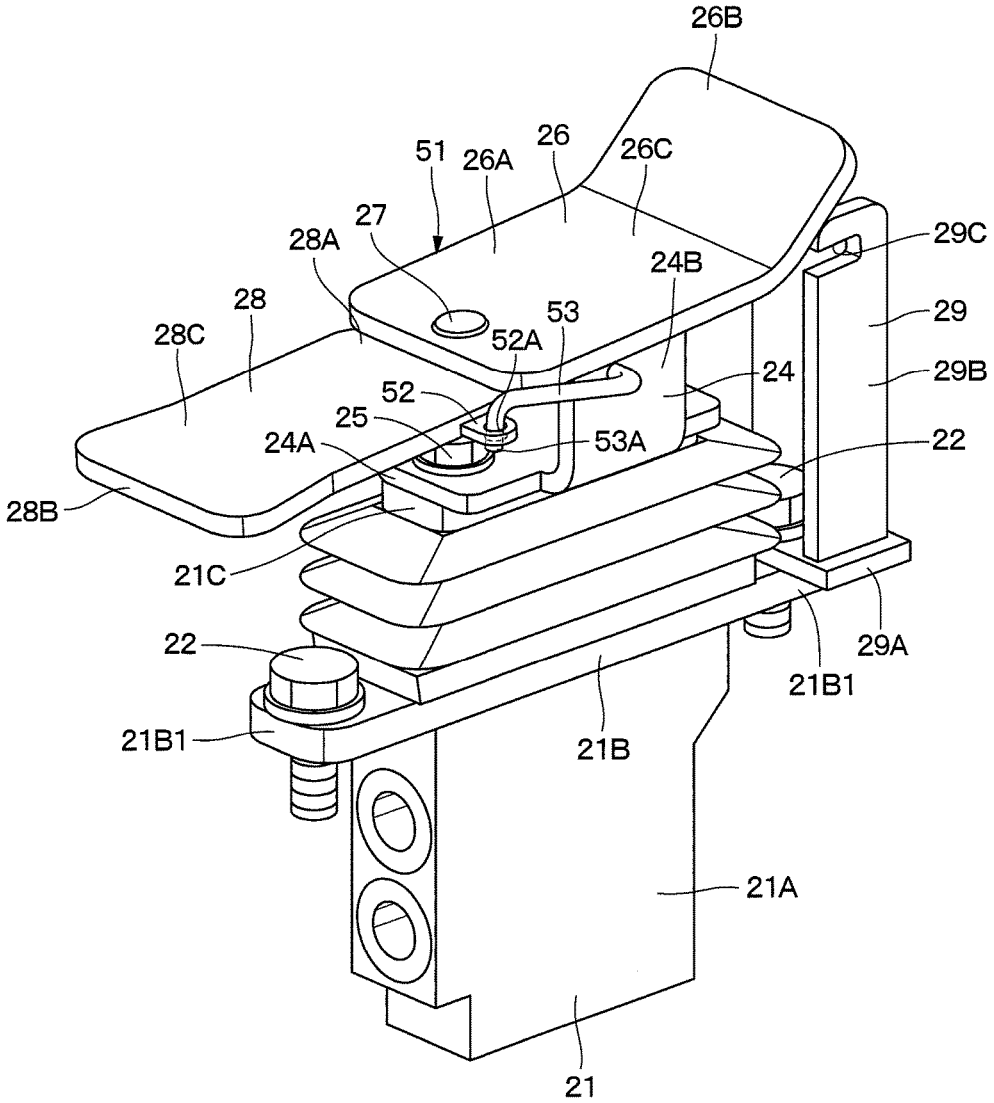
FIG. 13 is a perspective view showing an operating pedal provided with a stopper mechanism according to a third embodiment together with a pilot valve and an operation regulating mechanism as viewed from a position as similar to FIG. 10.
Figure 14:
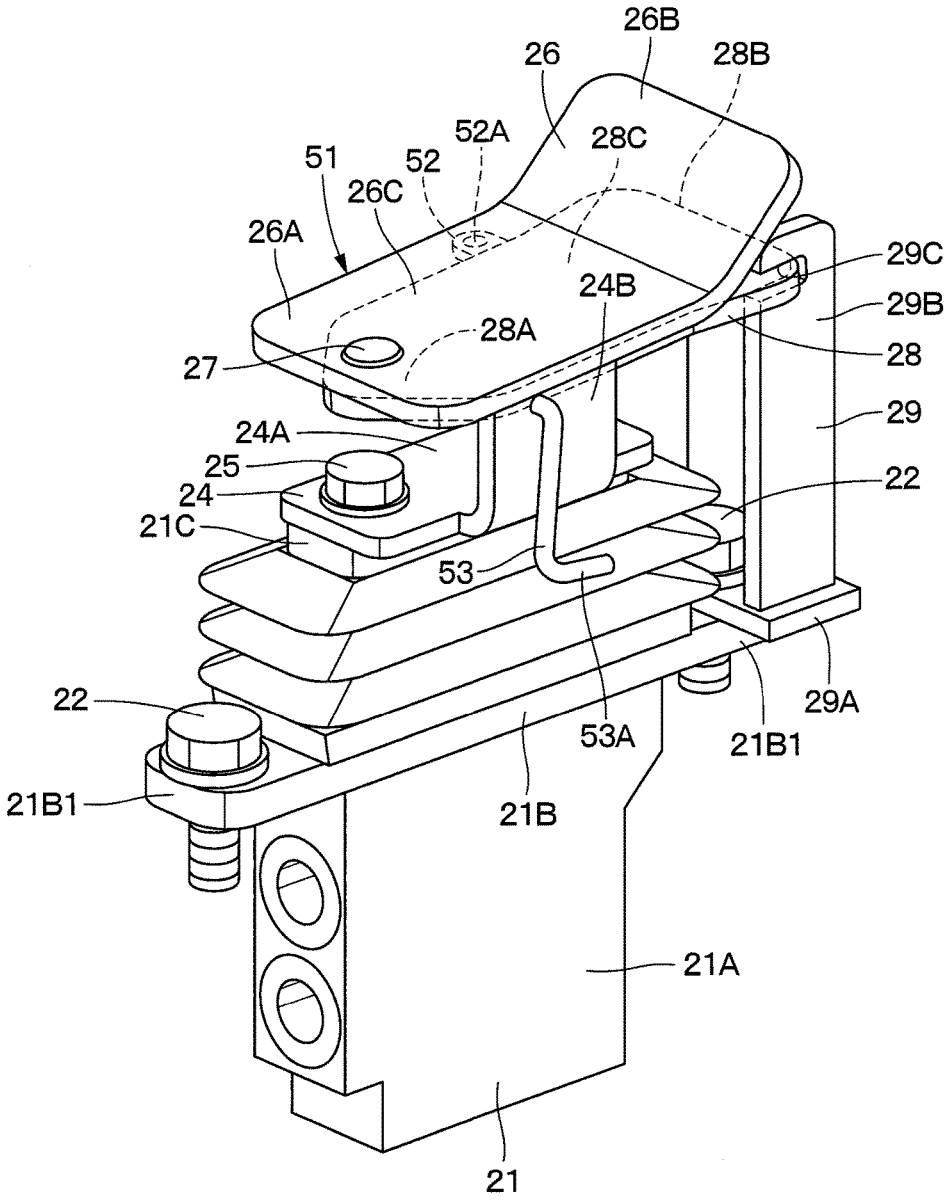
FIG. 14 is a perspective view showing a state where a lock by the stopper mechanism is released and a second foot board is arranged in a storage position as viewed from a position as similar to FIG. 13.

Next, FIG. 13 and FIG. 14 show a third embodiment of the present invention. The present embodiment is characterized in that one footboard of a first footboard and a second footboard is provided with an engagement member, and the other foot board of the first foot board and the second foot board is provided with a stopper member that regulates rotation of the second foot board to be fixed to a use position by engaging to the engagement member when the second foot board is rotated to the use position. It should be noted that in the present embodiment, components identical to those in the first embodiment as described above are referred to as identical reference numerals and an explanation thereof is omitted.

In FIG. 13, a left side operating pedal 51 (hereinafter, referred to as "operating pedal 51" simply) positioned in the left side according to the third embodiment includes, as approximately similar to the operating pedal 23 according to the first embodiment, the mounting bracket 24, the first foot board 26, the shaft 27 and the second foot board 28. However, the left side operating pedal 51 according to the third embodiment differs in a point where the second foot board 28 is provided with an engagement member 52 and the mounting bracket 24 configuring a part of the first foot board 26 is provided with a stopper member 53, from the operating pedal 23 according to the first embodiment.

The engagement member 52 is provided on the second foot board 28. Specifically, the engagement member 52 is provided on the second foot board 28 in a position of facing the vertical support plate 24B of the mounting bracket 24 when the second foot board 28 is arranged in the use position shown in FIG. 13. The engagement member 52 is formed of a tongue-shaped plate body, and has a through hole 52A penetrating in the upper-lower direction in such a manner that a free end portion 53A of the stopper member 53 is engaged to the through hole 52A.

The stopper member 53 is provided in the vertical support plate 24B of the mounting bracket 24 configuring a part of the first foot board 26. The stopper member 53 is formed by a bar-shaped body bent in a crank shape. One end side of the stopper member 53 is mounted on an upper part position of the vertical support plate 24B to be rotatable thereto. On the other hand, the other end side of the stopper member 53 is formed as the free end portion 53A bent in such a manner as to be capable of being inserted (engaged) in the through hole 52A of the engagement member 52.

The engagement member 52 and the stopper member 53 as configured in this way are engaged by inserting the free end portion 53A of the stopper member 53 in the through hole 52A of the engagement member 52 in a state where the second foot board 28 is arranged in the use position. Thereby, the rotation of the second foot board 28 is regulated, making it possible to fix the second foot board 28 to the use position.

In this way, also the third embodiment as configured above can obtain functions and effects as approximately similar to those in the first embodiment as described before. Particularly, in the third embodiment, by inserting the free end portion 53A of the stopper member 53 in the through hole 52A of the engagement member 52 for engagement, the rotation of the second foot board 28 is regulated, making it possible to fix the second foot board 28 to the use position. Thereby, the second foot board 28 can be prevented from deviating during operating the operating pedal 51 to improve the operability.

It should be noted that in the third embodiment, a case where the second foot board 28 is provided with the engagement member 52 and the mounting bracket 24 configuring a part of the first foot board 26 is provided with the stopper member 53 is explained as an example. However, the present invention is not limited thereto, but may be configured such that the second foot board 28 is provided with the stopper member 53, and the mounting bracket 24 configuring a part of the first foot board 26 is provided with the engagement member 52.

In the first embodiment, a case where the left side operating pedal 23 that is operated by a left foot can be folded from the first foot board 26 and the second foot board 28, and the operation regulating mechanism 29 is provided in the left side operating pedal 23 is explained as an example. However, the present invention is not limited thereto, but may be configured such that the first foot board 26, the second foot board 28 and the operation regulating mechanism 29 are provided in the right side operating pedal 30 that is operated by a right foot. This configuration can be likewise applied to the other embodiments.

In each of the embodiments, the small-sized hydraulic excavator 1 of a canopy specification provided with the canopy 35 that covers the upper side and the right lateral side of the operator's seat 17 is explained as an example. However, the present invention is not limited thereto, but may be applied to a small-sized hydraulic excavator of a cab specification provided with a cab that covers, for example, the upper side and circumference of an operator's seat.

Further, in each of the embodiments, the small-sized hydraulic excavator 1 of the super-small revolving type in which the upper revolving structure 4 and the offset front device 6 can fully revolve within the width dimension L of the lower traveling structure 2 is explained as an example. However, the present invention is not limited thereto, but may be applied to a small-sized hydraulic excavator of a backward small revolving type in which only an outer peripheral surface of a counterweight having, for example, a circular outer peripheral surface is accommodated within the width dimension L of the lower traveling structure 2 and can revolve within the vehicle width of the lower traveling structure 2.

DESCRIPTION OF REFERENCE NUMERALS

1: Small-sized hydraulic excavator
2: Lower traveling structure
3: Revolving device
4: Upper revolving structure
6: Offset front device (Front device)
7: Revolving frame
7A: Center frame
7B: Left front vehicle plate
7C: Right front vehicle plate
8: Floor support frame
8C: Lever/pedal mounting plate (Floor member)
9: Counterweight
10: Engine (Prime mover)
11: Hydraulic pump
13: Control valve device

15: Operator's seat stand
16: Floor member
17: Operator's seat
21: Left side pilot valve (Pilot valve)
23, 41, 51: Left side operating pedal (Operating pedal)
24, 42: Mounting bracket
26, 43: First foot board
27, 44: Shaft
28, 45: Second foot board
28A, 45E: Mounting portion
28B: Free end portion
29: Operation regulating mechanism
29B: Rising member
29C: Slit portion
46: Engagement Plate (Free end portion)
52: Engagement member
53: Stopper member
O1: Revolving center
O2: Axis line of shaft

The invention claimed is:

1. A small-sized hydraulic excavator of a small revolving type comprising:

an automotive lower traveling structure;

an upper revolving structure that is supported through a revolving device on said lower traveling structure; and a front device that is tiltably mounted in the front side of said upper revolving structure in a front-rear direction, wherein said upper revolving structure includes:

a revolving frame that is formed as a support structure;

a counterweight that is mounted in the rear side of said revolving frame for acting as a weight balance to said front device;

a prime mover that is positioned in the front side to said counterweight and is mounted on said revolving frame in a horizontal state of extending in a left-right direction to drive a hydraulic pump;

an operator's seat stand that is provided on said revolving frame to cover the upper side of said prime mover and on which an operator's seat is mounted; and a floor member that is positioned in the front side of said operator's seat stand to be provided in said revolving frame and the left side in the left-right direction of which is an entrance way to said operator's seat, and at least the rear side of said upper revolving structure can revolve within a vehicle width of said lower traveling structure, wherein a pilot valve is provided in a front position of said floor member to control supply/discharge of a pilot pressure to a control valve device, an operating pedal that is positioned in the upper side to said floor member and is foot-operated in an upper-lower direction by an operator to perform the supply/discharge of the pilot pressure is provided with said pilot valve, said operating pedal includes:

a first foot board that is mounted on said pilot valve to be rotatable in the upper-lower direction;

a shaft that is provided in a rear position of said first foot board; and a second foot board that is mounted through said shaft to said first foot board to be rotatable in a horizontal direction and is rotated at the center of said shaft between a storage position of overlapping said first foot board in a lower surface side thereof and a use position of being rotated in the rear side of said first foot board, and an operation regulating mechanism is provided in the front side of said first foot board to regulate a foot operation to said operating pedal by engaging to said second foot board when said second foot board is rotated to the storage position.

2. The small-sized hydraulic excavator according to claim 1, wherein said second foot board includes a mounting portion that is positioned in one side of a length direction and is mounted through said shaft on said first foot board to be rotatable to said first foot board, and a free end portion that is positioned in the other side of the length direction, said operation regulating mechanism is formed of a rising member that is mounted and risen on said pilot valve, and said rising member of said operation regulating mechanism is provided with a slit portion that regulates a foot operation to said operating pedal by engagement of said free end portion of said second foot board when said second foot board is rotated in said storage position.

3. The small-sized hydraulic excavator according to claim 1, wherein said first foot board and said second foot board each are formed using a plate body having an identical shape.

4. The small-sized hydraulic excavator according to claim 1, wherein one foot board of said first foot board and said second foot board is provided with an engagement member, and the other foot board of said first foot board and said second foot board is provided with a stopper member that is engaged to said engagement member when said second foot board is rotated to said use position to regulate rotation of said second foot board by fixing said second foot board to said use position.

5. The small-sized hydraulic excavator according to claim 1, wherein in said revolving frame, left and right vertical plates are provided to rise closer to the right side in the left-right direction than a revolving center of said upper revolving structure on a center frame on which a revolving circle of said revolving device is mounted and said front device is mounted in the front side of said respective vertical plates, and an entirety of said upper revolving structure including the rear side of said upper revolving structure and said front device in a super-small revolving attitude that is tilted and folded are capable of revolving within a vehicle width of said lower traveling structure.

* * * * *